US005154378A

United States Patent [19]

Plum

[11] Patent Number: 5,154,378

[45] Date of Patent: Oct. 13, 1992

[54] SUPPORT FOR GARBAGE DISPOSAL BAGS AND A BAG FOR USE WITH THE SUPPORT

[76] Inventor: Paul E. Plum, 8, Klampenborgvej, DK-2930 Klampenborg, Denmark

[21] Appl. No.: 689,927

[22] PCT Filed: Nov. 17, 1989

[86] PCT No.: PCT/DK89/00275

§ 371 Date: May 16, 1991

§ 102(e) Date: May 16, 1991

[87] PCT Pub. No.: WO90/05673

PCT Pub. Date: May 31, 1990

[30] Foreign Application Priority Data

Nov. 17, 1988 [DK] Denmark ..... 6419/88

[51] Int. Cl.[5] ..... B65B 67/00

[52] U.S. Cl. ..... 248/99; 312/212

[58] Field of Search ..... 248/95, 97, 98, 99, 248/100, 101; 312/212, 275; 383/23

[56] References Cited

U.S. PATENT DOCUMENTS

| | | | |
|---|---|---|---|
| 1,665,724 | 4/1928 | Way | 248/101 |
| 3,260,488 | 7/1966 | Kliewer et al. | 248/99 |
| 3,329,382 | 7/1967 | Ryan | 248/99 |
| 3,653,619 | 4/1972 | Plum | 248/99 |
| 3,724,921 | 4/1973 | Lake | 312/275 X |
| 4,750,638 | 6/1988 | Sosower . | |

FOREIGN PATENT DOCUMENTS

| | | | |
|---|---|---|---|
| 420688 | 4/1937 | Belgium . | |
| 2127436 | 12/1971 | Fed. Rep. of Germany | 312/212 |
| 193023 | 11/1964 | Sweden | 248/99 |
| 1073895 | 5/1965 | United Kingdom . | |

*Primary Examiner*—David L. Talbott
*Attorney, Agent, or Firm*—Browdy and Neimark

[57] ABSTRACT

A support for garbage disposal bags to be mounted in a cupboard and designed as a frame (3) consisting of bars (4 to 7) hingedly interconnected at their ends, the support being intended to carry a garbage disposal bag by its open end and after the mounting on the cupboard or on two sections of the cupboard movable relative to each other to occupy, on one hand, an open position in which the bag is kept open and, on the other hand, a closed position in which the bag is kept flattened at its open end, characterized in that the frame is shaped as a deformable bar-parallelogram comprising four bars, that the bar-parallelogram includes a central bar which at its ends is articulated with two opposite parallelogram bars and which divides the bar-parallelogram into two, mainly equally large openings for the placing of two garbage disposal bags, and that the parallelogram-bars and the central bar are shaped so in relation to each other that the parallelogram-bars and the central bar in the closed position of the frame bear against each other and combine to have the same thickness as the thickness of the two opposite parallelogram-bars in a direction perpendicular to the mounting surface of the cupboard when the two opposite parallelogram-bars are in a closed position, the bags being flattened between the frame bars.

11 Claims, 2 Drawing Sheets

SUPPORT FOR GARBAGE DISPOSAL BAGS AND A BAG FOR USE WITH THE SUPPORT

Figure 1:
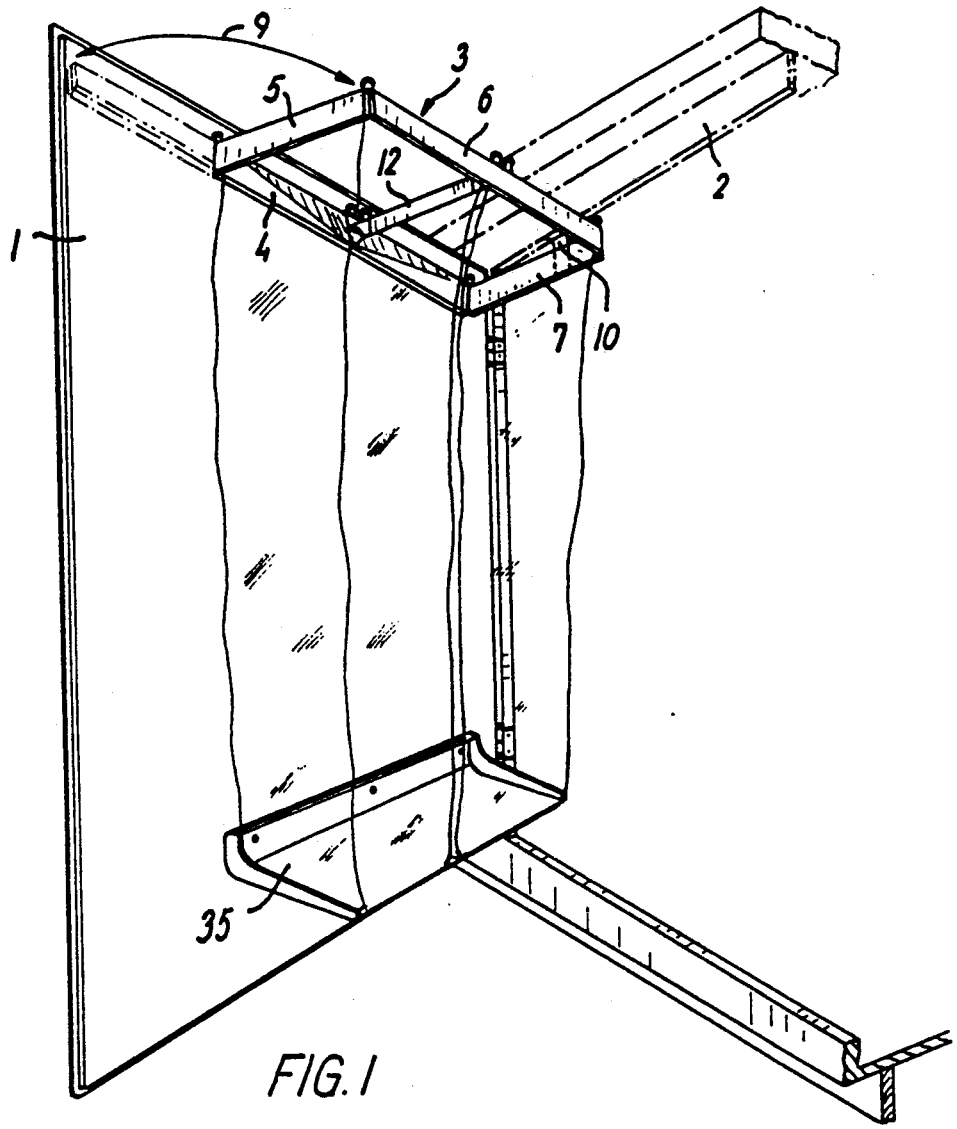

DK patent No. 120 275 discloses a support for garbage disposal bags to be mounted in a cupboard and designed as a frame consisting of bars hingedly interconnected at their ends, said support being intended to carry a garbage disposal bag by its open end and after the mounting on the cupboard or on two sections of the cupboard movable relative to each other to occupy, on one hand, an open position in which the bag is kept open and, on the other hand, a closed position in which the bag is kept flattened at its open end.

In a support of this type the bag carrying frame is hexagonal. DE publication No. DE-OS 2 127 436 deals with a garbage disposal bag support with a square bag carrying frame and DE publication No. DE OS 2 910 144 deals with a garbage disposal bag support with a rhomboid frame or with a frame approximately oval in its open position.

It is known that various authorities, e.g. municipal authorities, already make demands for or gradually will make demands for garbage sorting by the individual households. It is obvious that such sorting between bio-decomposable, i.e. compostable material and solid material, resp., such a plastic wrappings, milk cartons, etc., by private persons implies that the individual households dispose of garbage disposal bags or the like, since the sorting is generally effected by throwing the bio-decomposable material into the usual bag under the kitchen table, while throwing the more solid garbage into a bag or possibly a container for that purpose.

The above mentioned prior structures are only intended to carry one garbage disposal bag at a time and therefore cannot comply with the request of sorting garbage in one and the same bag holder in the kitchen.

The object of the invention is to provide a support for garbage disposal bags making it possible for the user to easily sort the garbage in two separate bags suspended on the same support.

In this respect a support for garbage disposal bags the type mentioned above is according to the invention characterized in that the frame is shaped as a deformable bar-parallelogram comprising four bars, that the bar-parallelogram includes a central bar which at its ends is articulated with two opposite parallelogram bars and which divides the bar-parallelogram into two, mainly equally large openings for the placing of two garbage disposal bags, and that the parallelogram-bars and the central bar are shaped so in relation to each other that the paralleogram-bars in the closed position of the frame bear against each other, the bags being flattened between the frame bars.

The advantage of a support so designed consists in that the central bar of the frame makes it possible to suspend two disposal bags, one in each opening of the frame, that the central bar contributes to suitably supporting said bags along four sides, and that the frame, usually mounted on a cupboard door, together with the bags is completely closed or collapsed upon closing the cupboard door. In spite of the presence of the central bar the thickness of the closed or collapsed frame in the horizontal direction away from the frame supporting surface, e.g. the cupboard door, will not exceed the thickness of an ordinary frame without a central bar, e.g. a square frame (cf. DE OS No. 2 127 436) or a hexagonal frame (cf. DK patent No. 120 275).

It is evident that the presence of the central bar in the frame implies a suitable shaping of the frame components and according to an advantageous embodiment the support may further be characterized in that the two opposite bars hingedly connected with the central bar are individually provided with two chamfered faces that are interior in relation to the frame and substantially shaped as a triangle with mainly coincident bottom line at the point of articulation, the triangle vertex facing towards the ends of the bar concerned, and that the central bar has a cross-sectional shape as a triangle, viewed in a vertical, transverse plane, the vertex of which facing the underside of the frame. This respective shaping of the frame bars and central bar allows the central bar to be placed between the bars without increasing the frame thickness in the horizontal direction away from the cupboard door.

In view of the parallelogram deformation from open to closed position of the frame, or vice versa, it is advantageous that the articulations between the ends of the central bar and the associated frame bars are constituted by vertical pivot pins inwardly staggered in the frame in relation to the vertical plane which includes the axes of the hinged connections of the respective frame bar, and in that the central bar is telescopic.

In order to make the central bar telescopic it is advantageous that the central bar consists of a cross-sectionally triangular hollow profile and at least one end piece inserted in the hollow profile in displaceable relationship thereto and which at the pivot pin is hingedly connected with the respective frame bar.

In order to carry the disposal bags the frame may in a manner known per se be provided with bag carrying pins on the top side of the frame and with a view to make it possible for the user to separately mount or remove each bag it is according to the invention advantageous that there are provided four bag carrying pins for each opening in the frame, preferably one pin at each corner of the respective opening.

The invention also relates to a bag for use in a support for garbage disposal bags according to the invention, said bag being characterized in that four perforations or apertures mainly equidistant in the direction parallel to the frame are provided in the bag material and at the open end of the bag for suspending the bag on the associated carrying pins.

Figure 4:
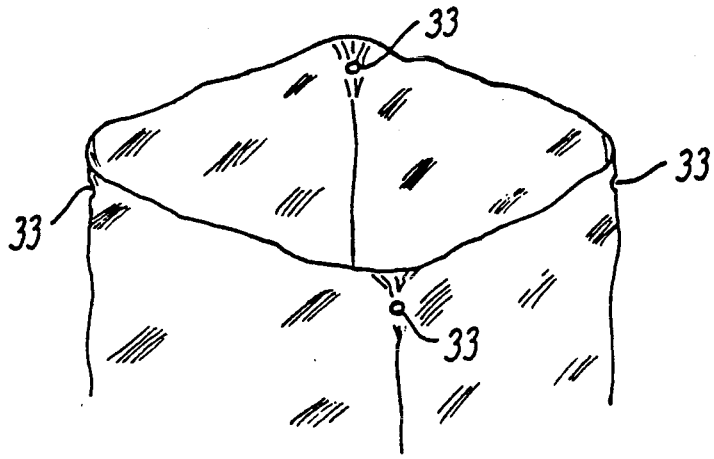
Figure 2:
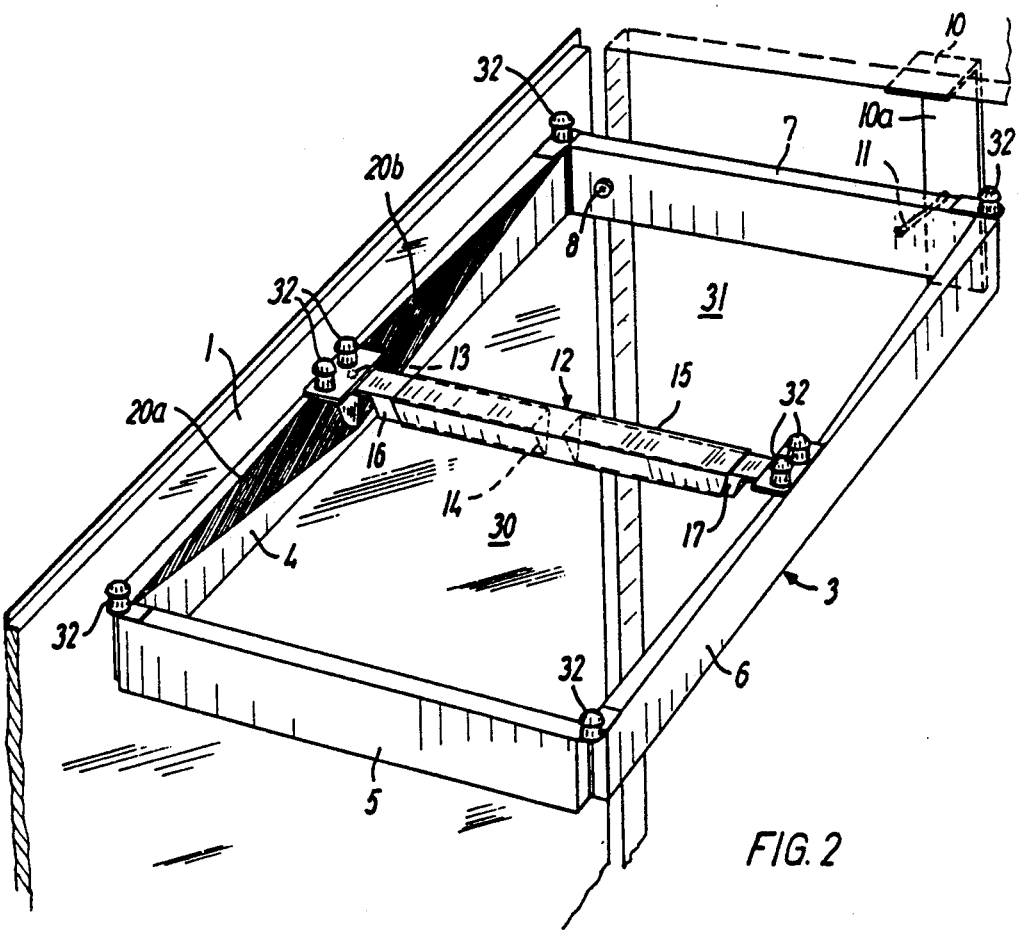
Figure 3:
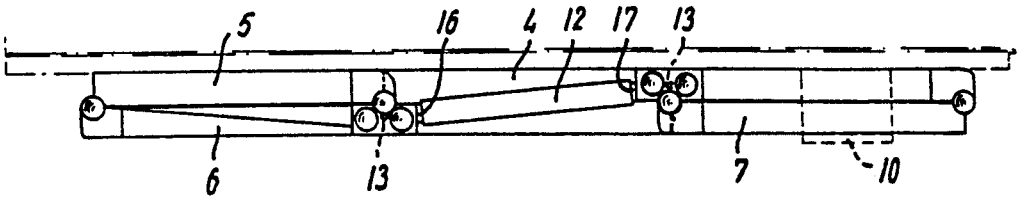

The invention will now be explained in more detail with reference to the schematical drawings, in which FIG. 1 is a perspective view of a garbage disposal bag support according to the invention, mounted on a cupboard door, FIG. 2 is a perspective view of the support according to the invention, FIG. 3 illustrates the support in closed, i.e. collapsed, position, viewed from above, and FIG. 4 shows a bag appropriate for use in connection with the support according to the invention.

FIG. 1 illustrates the cupboard door 1 in open position in relation to the associated casing 2, shown in dash-and-dot lines, under a kitchen table. A preferably rectangular frame 3 is mounted on the upper section of the inner side of the cupboard door 12, said frame comprising four bars 4 to 7 hingedly interconnected at the corners of the frame. The bar 4 is secured, e.g. screwed on cupboard door 1 in such a manner that the entire frame is horizontal.

As it will appear from FIG. 1, and in more detail from FIG. 2, frame 3 is composed of two long bars 4, 6 and two shorter bars 5, 7. Said four bars 4 to 7 may for instance consist of moulded plastic material and the articulations at the four corners of the frame may have a conventional design known per se, but they consist preferably of a tongue at one end of each individual bar, said tongue being inserted in a corresponding slit in the opposite end of the adjacent bar and retained there by means of a transverse plug 8.

Due to this design the frame 3 may occupy the open position, illustrated in FIGS. 1 and 2, or a closed position, in which the four bars 4 to 7 are "collapsed". In FIG. 1 the dot-and-dash line illustrates the closed position and the arrow 9 shows the closing direction of the frame.

On the underside of the upper section of casing 2 beneath the kitchen table proper an angle piece 10 is secured whose leg 10*a* extends downwards and has for its purpose to retain bar 7 of frame 3 upon closing cupboard door 1, thereby collapsing the frame. A short wire 11 connects the innermost bar 7 with piece 10 and is intended to retain bar 7 in the position shown in FIG. 2 mainly parallel to casing 2 upon opening cupboard door 1. As it will appear from FIG. 2, hinge 10 under the kitchen table is preferably mounted near the end of frame bar 7 facing away from cupboard door 1 with a view to avoid bending frame bar 7 upon closing cupboard door 1.

As it appears from FIGS. 1 and 2, frame 3 includes a central bar 12 which from the middle of bar 4 mounted on cupboard door 1 extends parallel to the two short bars 5, 7 of the frame onwards to the middle of the other long bar 6.

Central bar 12 is hingedly connected with said two long bars 4, 6 by means of vertical pivot pins of which only one is shown by 13 in FIG. 2. Central bar 12 which may likewise be made from plastic material has a triangular shape as illustrated by 14 in FIG. 2, the bottom line of the triangle facing upwards and the triangle vertex facing downwards.

In the illustrated embodiment central bar 12 consists of a triangular hollow profile 15 and two triangular end pieces 16, 17 inserted in either end of hollow profile 15 and both of which are provided with a pivot pin 13 for hingedly connecting central bar 12 with bars 4, 6.

As it appears from FIG. 2, bar 4 of frame 3 is provided with two chamfered faces 20*a*, 20*b* (shown in hatching lines in FIG. 2) that are symmetrical in relation to the point of articulation of central bar 12 with the bar (pivot pin 13).

Said chamfered faces have a triangular shape, the vertex being positioned at one end and at the other end, resp., of the bar, i.e. at one corner and at the other corner, resp., of the frame, and with bottom lines coincident with the point of articulation (pivot pin 13). This design of bar 4 obtained for instance by casting in a mould fitted for that purpose implies that, while the lower edge of bar 4 has a constant width throughout its length, the upper edge of the bar has a width that is narrowing until the middle of the bar (at pivot pin 13) and is then widening until the opposite end, as it also appears from FIG. 2.

The opposite bar 6 of frame 3 has the same shape.

This particular design of the two long frame bars 4, 6 and of the central bar 12 permits to completely collapse frame 3, thereby flattening the bags between the frame bars upon closing cupboard door 1. When collapsed, as illustrated in FIG. 3, bars 4 to 7 of the frame bear on each other, central bar 13 being positioned in the intermediate space provided by the chamfered faces of the one bar 4 and the other bar 6, respectively. Due to the particular, triangular form of the chamfered faces central bar 12—in the collapsed condition of the frame, FIG. 3—will be positioned somewhat obliquely in relation to the longitudinal direction of the bars.

The reason why central bar 12 is telescopic is that its pivot pins 13 are displaced in relation to the vertical plane including the hinge axes of the frame at the one pair of corners and at the other pair of corners, respectively.

In the collapsed condition the garbage disposal bags are also completely closed.

FIG. 4 shows the shape of an appropriate disposal bag made for instance from plastic or paper. In order to ensure a bag being retained in either of the two openings 30, 31 in the frame, i.e. one bag on either side of the central bar 12, frame 3 is provided with a number of pins 32 engaging corresponding perforations 33 in the bag, cf. FIG. 4. In the illustrated design there are four such pins 32 for each opening 30, 31 in the frame and the bag perforations have advantageously a larger diameter than the carrying pins 32 and are equidistant in the direction parallel to the frame, thereby making it easier for weak-sighted or elderly persons to mount the bags.

The bottom of the bag or bags is supported on a tray 35 secured to door 1. The bag or bags are suspended on bars 4 to 7 and central bar 12 by thrusting the pins 32 into the perforations provided in the bag or bags.

It should finally be observed that the design of the frame bars 4, 6 with the two chamfered faces 20*a*, 20*b* on each bar permits to collapse the frame 3 in two directions, viz. in the direction illustrated by arrow 9 and in dotted line, when cupboard door 1 as shown in FIG. 1 is left-hinged, and in the opposite direction if the cupboard door is right-hinged.

I claim:

1. A support for garbage disposal bags to be mounted in a cupboard and designed as a frame (3) consisting of bars (4 to 7) hingedly interconnected at their ends, said support being intended to carry a garbage disposal bag by its open end and after the mounting on the cupboard or on two sections of the cupboard movable relative to each other to occupy, on one hand, an open position in which the bag is kept open and, on the other hand, a closed position in which the bag is kept flattened at its open end, characterized in that the frame is shaped as a deformable bar-parallelogram comprising four bars, that the bar-parallelogram includes a central bar which at its ends is articulated with two opposite parallelogram bars and which divides the bar-parallelogram into two, mainly equally large openings for the placing of two garbage disposal bags, and that the parallelogram-bars and the central bar are shaped so in relation to each other that the parallelogram-bars and the central bar in the closed position of the frame bear against each other and combine to have the same thickness as the thickness of said two opposite parallelogram-bars in a direction perpendicular to the mounting surface of the cupboard when said two opposite parallelogram-bars are in a closed position, the bags being flattened between the frame bars.

2. A support for garbage disposal bags as claimed in claim 1, characterized in that the two opposite bars (4, 6) hingedly connected with the central bar (12) are individually provided with two chamfered faces (20*a*, 20*b*) that are interior in relation to the frame (3) and substantially shaped as a triangle with mainly coincident bottom line at the point of articulation, the triangle vertex facing towards the ends of the bar concerned, and that the central bar (12) has a cross-sectional shape as a triangle, viewed in a vertical, transverse plane, the vertex of which facing the underside of the frame (3).

3. A support for garbage disposal bags as claimed in claim 2, characterized in that the articulations between the ends of the central bar (12) and the associated frame bars (4, 6) are constituted by vertical pivot pins (13) inwardly staggered in the frame in relation to the vertical plane which includes the axes of the hinged connections of the respective frame bar (4, 6), and in that the central bar (12) is telescopic.

4. A support for garbage disposal bags as claimed in claim 3, characterized in that the central bar (12) consists of a cross-sectionally triangular hollow profile and at least one end piece (16 or 17) inserted in the hollow profile in displaceable relationship thereto and which at the pivot pin (13) is hingedly connected with the respective frame bar (4 or 6).

5. A support for garbage disposal bags as claimed in claim 1 and provided with carrying pins on the top side of the frame, characterized in that there are provided four bag carrying pins (32) for each of said two openings (30, 31) in the frame (3), wherein one of said four bag carrying pins is located at each corner of said each of said two openings.

6. A disposal bag for use in a garbage bag support according to claim 5, characterized in that four perforations or apertures (33) mainly equidistant in the direction parallel to the frame are provided in the bag material and at the open end of the bag for suspending the bag on the associated carrying pins (32).

7. A support for garbage disposal bags to be mounted in a cupboard and designed as a frame (3) consisting of bars (4 to 7) hingedly interconnected at their ends, said support being intended to carry a garbage disposal bag by its open end and after the mounting on the cupboard or on two sections of the cupboard movable relative to each other to occupy, on one hand, an open position in which the bag is kept open and, on the other hand, a closed position in which the bag is kept flattened at its open end, characterized in that the frame is shaped as a deformable bar-parallelogram comprising four bars, that the bar-parallelogram includes a central bar which at its ends is articulated with two opposite parallelogram bars and which divides the bar-parallelogram into two, mainly equally large openings for the placing of two garbage disposal bags, that the parallelogram-bars and the central bar are shaped so in relation to each other that the parallelogram-bars in the closed position of the frame bear against each other, the bags being flattened between the frame bars, and that said two opposite bars (4, 6) hingedly connected with the central bar (12) are individually provided with two chamfered faces (20*a*, 20*b*) that are interior in relation to the frame (3) and substantially shaped as a triangle with mainly coincident bottom line at the point of articulation, the triangle vertex facing towards the ends of the bar concerned, and that the central bar (12) has a cross-sectional shape as a triangle, viewed in a vertical, transverse plane, the vertex of which facing the underside of the frame (3).

8. A support for garbage disposal bags as claimed in claim 7, characterized in that the articulations between the ends of the central bar (12) and the associated frame bars (4, 6) are constituted by vertical pivot pins (13) inwardly staggered in the frame in relation to the vertical plane which includes the axes of the hinged connections of the respective frame bar (4, 6), and in that the central bar (12) is telescopic.

9. A support for garbage disposal bags as claimed in claim 8, characterized in that the central bar (12) consists of a cross-sectionally triangular hollow profile and at least one end piece (16 or 17) inserted in the hollow profile in displaceable relationship thereto and which at the pivot pin (13) is hingedly connected with the respective frame bar (4 or 6).

10. A support for garbage disposal bags as claimed in claim 7 and provided with carrying pins on the top side of the frame, characterized in that there are provided four bag carrying pins (32) for each of said two openings (30, 31) in the frame (3), wherein one of said four bag carrying pins is located at each corner of said each of said two openings.

11. A disposal bag for use in a garbage bag support according to claim 10, characterized in that four perforations or apertures (33) mainly equidistant in the direction parallel to the frame are provided in the bag material and at the open end of the bag for suspending the bag on the associated carrying pins (32).

* * * * *